US006550695B1

(12) United States Patent
Trent

(10) Patent No.: US 6,550,695 B1
(45) Date of Patent: Apr. 22, 2003

(54) SHOWER HEAD INCLUDING INTEGRAL CONTAINERS FOR DISPENSING PRODUCTS

(76) Inventor: Cecilio Trent, 153 Lott Apartment No. 1, Brooklyn, NY (US) 11226

( * ) Notice: Subject to any disclaimer, the term of this patent is extended or adjusted under 35 U.S.C. 154(b) by 0 days.

(21) Appl. No.: 10/157,886

(22) Filed: May 31, 2002

(51) Int. Cl.[7] ..... B05B 7/26; A62C 31/00

(52) U.S. Cl. ..... 239/310; 239/305; 239/419; 222/132

(58) Field of Search ..... 239/305, 310, 239/315, 316, 407, 419, 548, 558, 559, 567; 222/132, 135

(56) References Cited

U.S. PATENT DOCUMENTS

| | | | | |
|---|---|---|---|---|
| 3,653,554 A | | 4/1972 | Turben | |
| 3,713,585 A | * | 1/1973 | Conklin | 239/307 |
| 3,917,172 A | | 11/1975 | O'Hare | |
| 4,019,658 A | | 4/1977 | Consaul | |
| 4,200,206 A | | 4/1980 | Chase et al. | |
| 4,218,013 A | | 8/1980 | Davison | |
| 4,358,056 A | | 11/1982 | Greenhut et al. | |
| 4,840,311 A | | 6/1989 | Shamblin | |
| 4,881,575 A | | 11/1989 | Smith | |
| 5,071,070 A | * | 12/1991 | Hardy | 239/311 |
| 5,135,173 A | | 8/1992 | Cho | |
| 5,174,503 A | | 12/1992 | Gassaway | |
| D334,229 S | | 3/1993 | Hiller | |
| 5,333,789 A | | 8/1994 | Garneys | |
| 5,351,892 A | * | 10/1994 | Conte | 239/304 |
| 5,454,516 A | | 10/1995 | Smyrl | |
| 5,716,005 A | | 2/1998 | McMahan | |
| 6,041,971 A | | 3/2000 | Pineda | |

* cited by examiner

*Primary Examiner*—Gregory Huson
*Assistant Examiner*—Lina R Kontos
(74) *Attorney, Agent, or Firm*—Carlos R. Villamar

(57) ABSTRACT

A shower head, including a container section partitioned into a plurality of containers for storing a plurality of respective products to be dispensed; a selection section rotatably mounted on the container section for selecting a product to be dispensed via an opening provided in the selection section; a mixing section coupled to the selection section for receiving a selected product from the selection section and mixing the selected product with a water stream; and an internal water spout passing through the container section and the selection section into the mixing section for introducing the stream of water into the mixing section for mixing with the selected product.

18 Claims, 5 Drawing Sheets

SHOWER HEAD INCLUDING INTEGRAL CONTAINERS FOR DISPENSING PRODUCTS

FIELD OF THE INVENTION

The present invention generally relates to shower heads and more particularly to a shower head including integral containers for dispensing products into a shower stream.

DISCUSSION OF THE BACKGROUND

Over the years, various types of devices related to showers, shower heads, liquid dispensing devices for showers, etc., have been developed. Accordingly, this is an active and crowded field of art. Most previous attempts, although fulfilling their various objects, suffer from problems resulting in a lack of acceptance into the consumer market place. This is evidenced by the numerous patents that have been issued in this crowded filed, but are yet to see the light of day in the commercial market place.

For example, U.S. Pat. No. 3,653,554 to Turben, U.S. Pat. No. 3,713,585 to Conklin, U.S. Pat. No. 3,917,172 to to O'Hare, U.S. Pat. No. 4,019,658 to Consaul, U.S. Pat. No. 4,200,206 to Chase et al., U.S. Pat. No. 4,218,013 to Davison, U.S. Pat. No. 4,358,056 to Greenhut et al., U.S. Pat. No. 4,840,311 to Shamblin, U.S. Pat. No. 4,881,575 to Smith, U.S. Pat. No. 5,135,173 to Cho, U.S. Pat. No. 5,174,503 to Gasaway, U.S. Pat. No. 5,333,789 to Garneys, U.S. Pat. No. 5,454,516 to Smyrl, U.S. Pat. No. 5,716,005 to McHahan, etc., are directed to devices for dispensing liquid products into a shower stream. Such devices, however, suffer from a range of problems, including complex design and operation, external fixtures required to mount the devices in a shower, external containers for dispensing products, bulkiness, difficulties in manufacturing and installation, etc.

Therefore, there is a need for a device for dispensing products into a shower stream that is simple to use and manufacture, that does not require external fixtures to mount the device in a shower, and that does not require external containers for dispensing products.

SUMMARY OF THE INVENTION

The above and other needs are addressed by the present invention, which provides an improved shower head including integral containers for dispensing products into a shower stream. The shower head includes a plurality of integral containers that can be filled or re-filled with various products, such as liquid or solid soaps, shampoos, conditioners, etc. A selector mechanism is provided for introducing a product from a selected container into a shower stream. Advantageously, the shower head is of a compact and aesthetically pleasing design, can easily be mounted on an existing shower without any external mounting fixtures or containers, is easy to manufacture and operate, and generally overcomes many of the numerous problems noted with respect to prior art devices.

Accordingly, in one aspect of the present invention, there is provided an improved shower head, including a container section partitioned into a plurality of containers for storing a plurality of respective products to be dispensed; a selection section rotatably mounted on the container section for selecting a product to be dispensed via an opening provided in the selection section; a mixing section coupled to the selection section for receiving a selected product from the selection section and mixing the selected product with a water stream; and an internal water spout passing through the container section and the selection section into the mixing section for introducing the stream of water into the mixing section for mixing with the selected product.

In another aspect of the present invention there is provided an improved shower head, including a container means including a plurality of containers therein for storing a plurality of respective products to be dispensed; a selection means rotatably mounted on the container means for selecting a product to be dispensed via an opening provided in the selection means; a mixing means coupled to the selection means for receiving a selected product from the selection means and mixing the selected product with a water stream; and an internal water spout means passing through the container means and the selection means into the mixing means for introducing the stream of water into the mixing means for mixing with the selected product.

In another aspect of the present invention there is provided an improved method of using a shower head including container, selection and mixing means, the method including storing a product to be dispensed in one of a plurality of containers of the container means; and selecting the product to be dispensed by rotating the selection means rotatably mounted on the container means and including an opening provided therein. The mixing means coupled to the selection means receives the selected product from the selection means and mixes the selected product with a water stream. An internal water spout means passing through the container means and the selection means into the mixing means introduces the stream of water into the mixing means for mixing with the selected product.

Still other aspects, features, and advantages of the present invention are readily apparent from the following detailed description, simply by illustrating a number of particular embodiments and implementations, including the best mode contemplated for carrying out the present invention. The present invention is also capable of other and different embodiments, and its several details can be modified in various respects, all without departing from the spirit and scope of the present invention. Accordingly, the drawing and description are to be regarded as illustrative in nature, and not as restrictive.

BRIEF DESCRIPTION OF THE DRAWINGS

The present invention is illustrated by way of example, and not by way of limitation, in the figures of the accompanying drawings, in which like reference numerals refer to similar elements, and in which.

DETAILED DESCRIPTION OF THE PREFERRED EMBODIMENTS

An improved shower head including integral containers for dispensing products into a shower stream is described. In the following description, for purposes of explanation, numerous specific details are set forth in order to provide a thorough understanding of the present invention. It is apparent to one skilled in the art, however, that the present invention can be practiced without these specific details or with an equivalent arrangement. In some instances, well-known structures and devices are shown in block diagram form in order to avoid unnecessarily obscuring the present invention.

Figure 1:
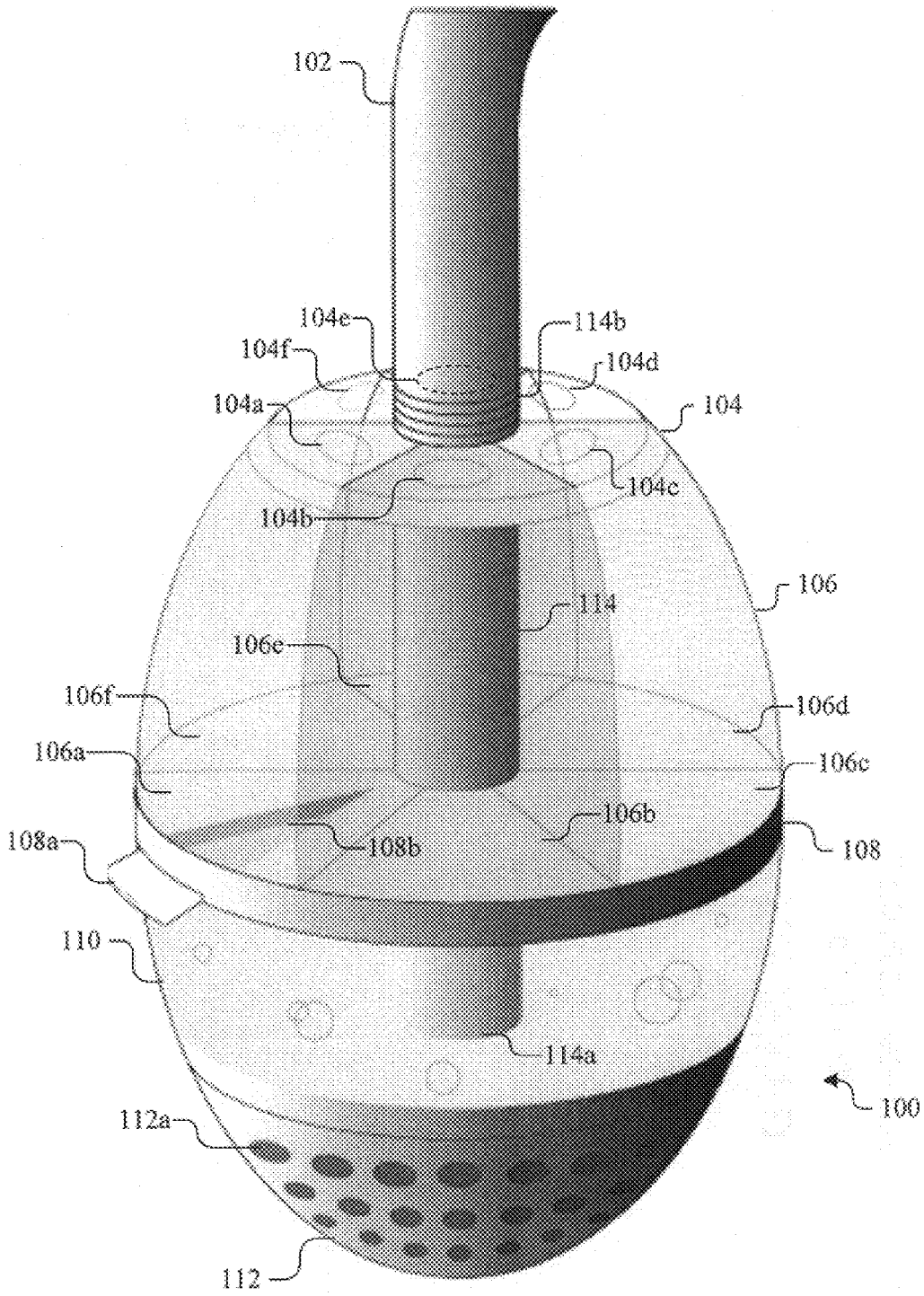
FIG. 1 is a diagram illustrating an exemplary shower head including integral containers for dispensing products into a shower stream, according to the present invention.
Figure 2A:
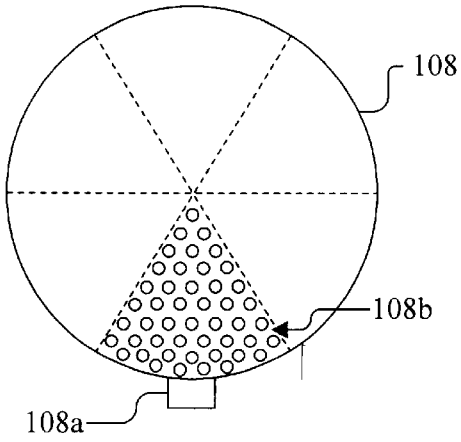
FIGS. 2*a*–2*e* are diagrams illustrating exemplary features of the shower head of FIG. 1, according to the present invention.
Figure 2B:
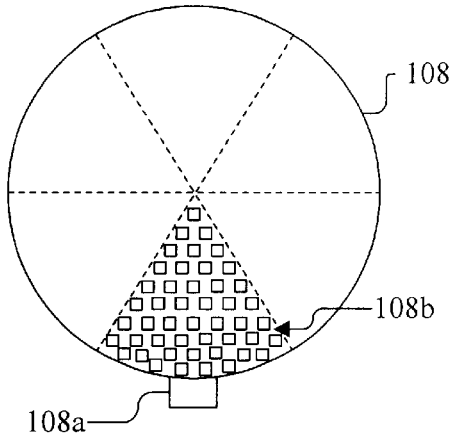
Figure 2C:
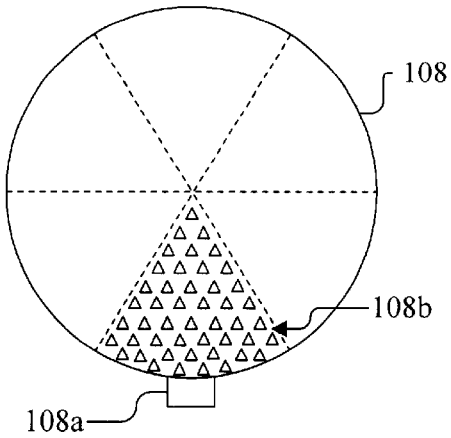
Figure 2D:
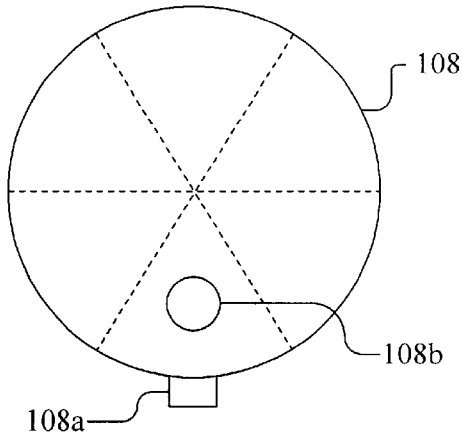
Figure 2E:
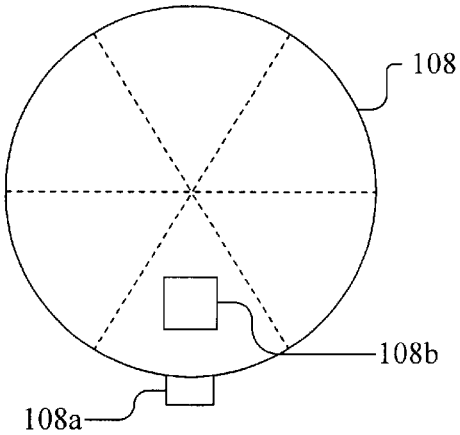

Referring now to the drawings, wherein like reference numerals designate identical or corresponding parts throughout the several views, and more particularly to FIG. 1 thereof, there is illustrated a shower head 100, according to the present invention. As shown in FIG. 1, the shower head 100 can be mounted onto an existing shower head water spout 102 via threads 114*b* of an internal water spout 114.

The shower head 100 also includes a plurality of sections 104–112 that perform various functions. A product introduction section 104 includes a plurality of openings 104*a*–104*e* for introducing products, such as liquid or solid soaps, shampoos, conditioners, etc., into respective product containers 106*a*–106*e* of a container section 106. The openings 104*a*–104*e* can include a cover, cap, cork, plug, etc., (not shown) for covering the openings 104*a*–104*e*. A product selection section 108 is rotatably mounted beneath the product introduction section 104 and includes a selection tab 108*a* and opening 108*b* for introducing a product contained in on of the respective product containers 106*a*–106*e* into a mixing section 110.

The internal water spout 114 passes through the container section 106 into the mixing section 110. The internal water spout 114 introduces a shower stream into the mixing section 110 via an outlet 114*a*. The shower stream then is combined with a product selected via the selection tab 108*a* and dispensed into the mixing section 110 via the opening 108*b* (e.g., including one or more triangle-shaped, circular-shaped, square shaped, etc., openings 108*b* therein, as shown in FIGS. 1 and 2*a*–2*e*). Thus, the selected product is mixed with the shower stream in the mixing section 110 for delivery to a user of the shower head 100 through a plurality of openings 112*a* of a dispensing section 112.

Accordingly, the present invention provides an improved shower head 100 including integral containers 106*a*–106*f* for dispensing products into a shower stream. Advantageously, the integral containers 106*a*–106*f* can be filled or re-filled with various products, such as liquid or solid soaps, shampoos, conditioners, etc., without the need for external product dispensing containers to be attached to the shower head, external fixtures for holding product containers, etc., as in the background art devices.

The selector mechanism 108 is provided for introducing a product from a selected container 106*a*–106*f* into a shower stream. Advantageously, this provides a simple and easy to use design, without the need for valves, complex mechanisms, external fixtures, etc., as in the background art devices.

Advantageously, the shower head 100 is of a compact and aesthetically pleasing design, can easily be mounted on an existing shower without any external mounting fixtures, containers, etc., is easy to manufacture and operate, and generally overcomes many of the numerous problems noted with respect to the background art devices.

Figure 3A:
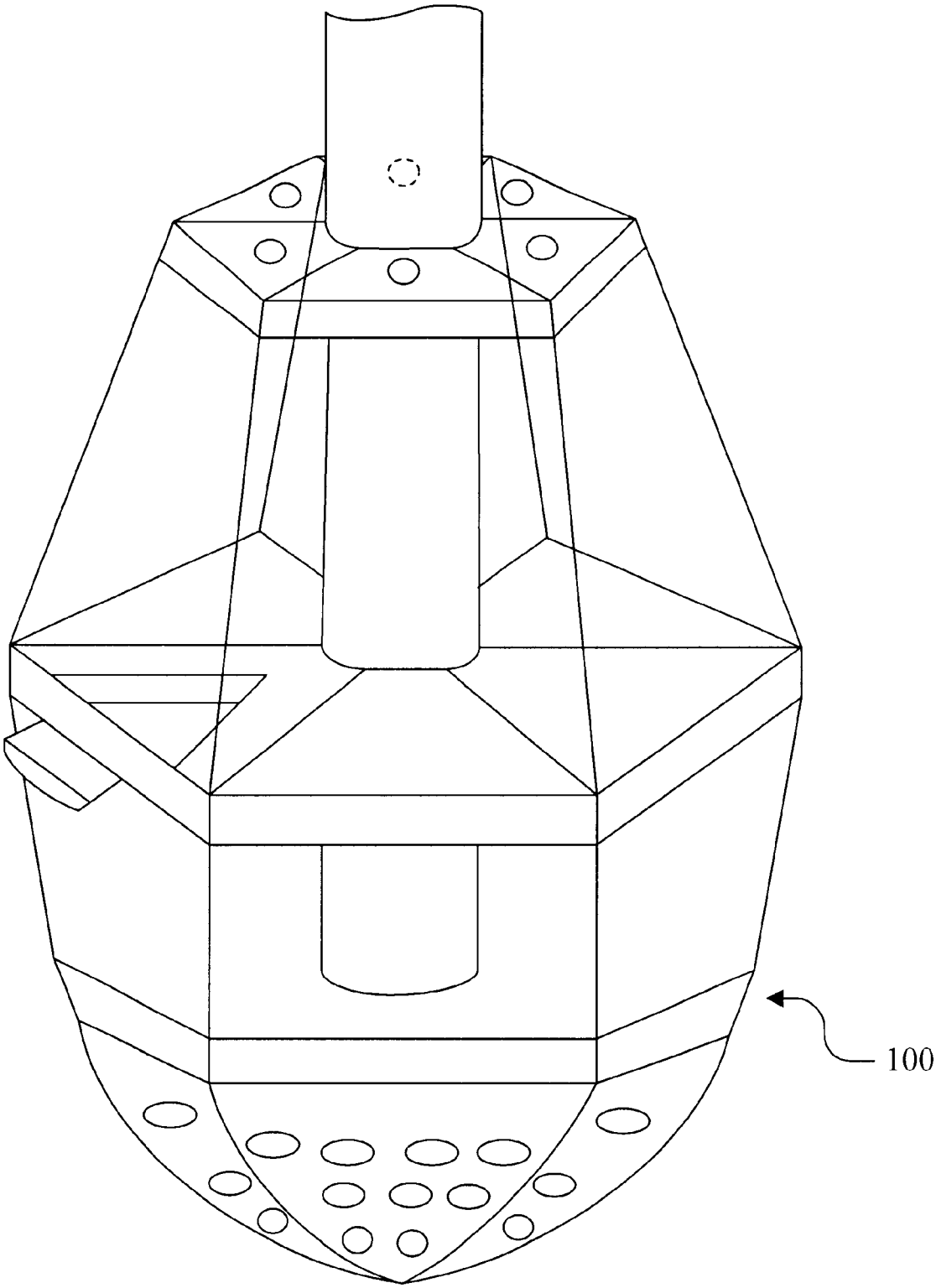
FIGS. 3*a*–3*c* are diagrams illustrating an exemplary shower head including integral containers for dispensing products into a shower stream, according to other embodiments of the present invention.
Figure 3B:
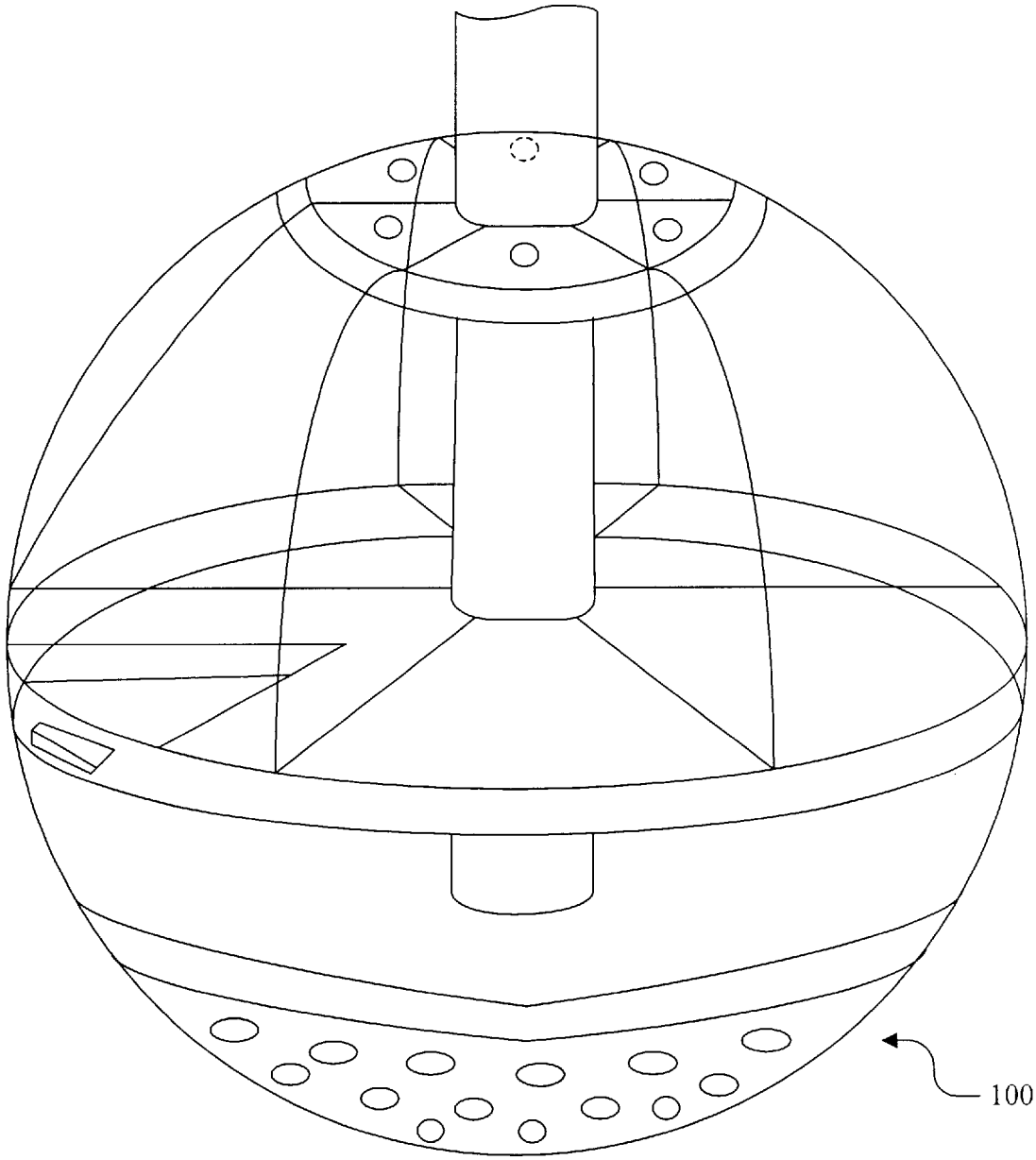
Figure 3C:
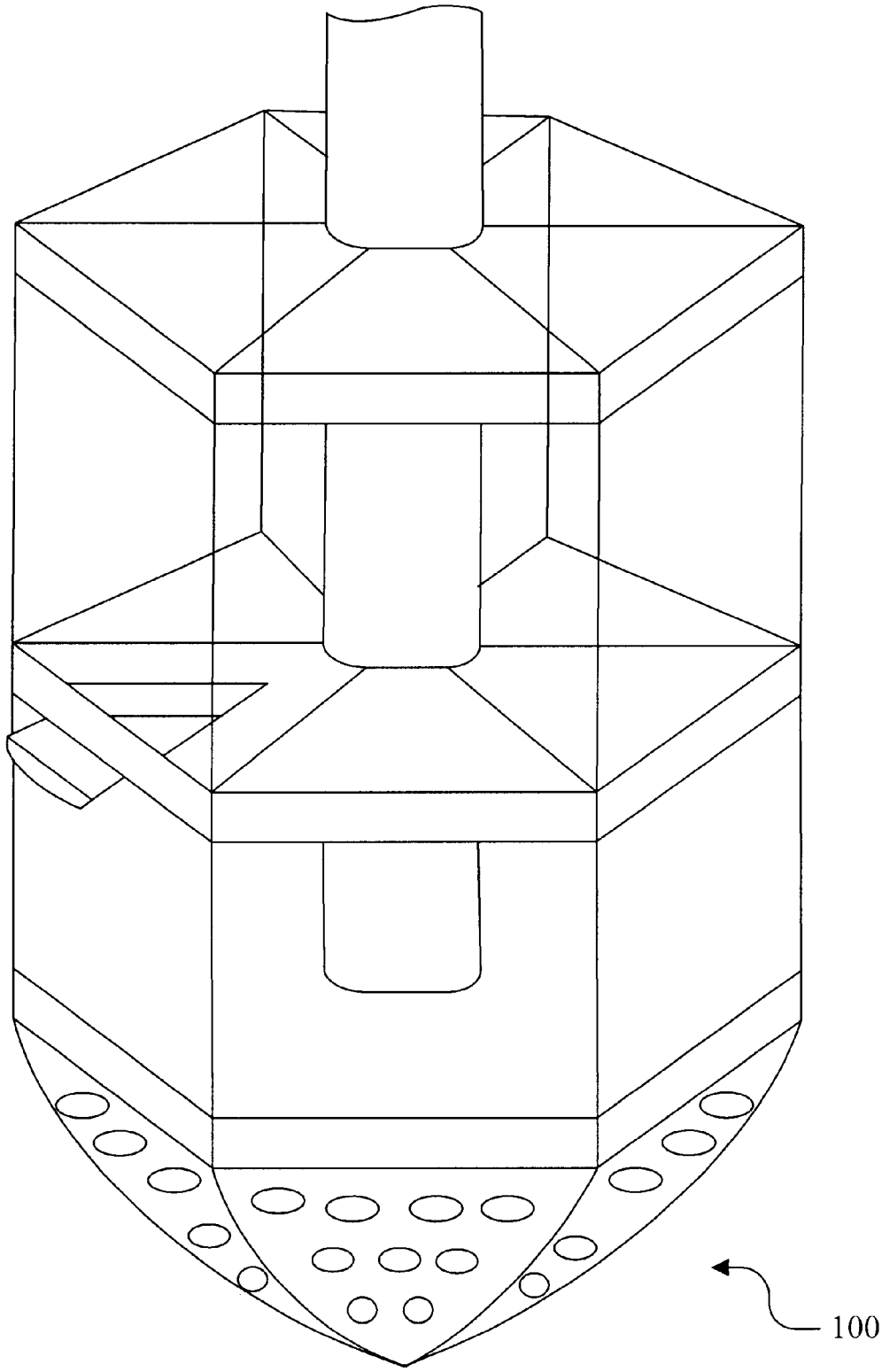

Although the shower head 100 is described in FIG. 1 in terms of being egg-shaped, the shower head 100 can be made to take on other shapes, such as diamond-shaped, square-shaped, circular-shaped, etc., for example, as shown in FIGS. 3*a*–3*c*, as will be appreciated by those skilled in the shower head arts.

While the present invention has been described in connection with a number of embodiments and implementations, the present invention is not so limited but rather covers various modifications and equivalent arrangements, which fall within the purview of the appended claims.

What is claimed is:

1. A shower head, comprising:

a container section partitioned into a plurality of containers for storing a plurality of respective products to be dispensed;

a selection section rotatably mounted on the container section for selecting a product to be dispensed via an opening provided in the selection section;

a mixing section coupled to the selection section for receiving a selected product from the selection section and mixing the selected product with a water stream; and an internal water spout passing through the container section and the selection section into the mixing section for introducing the stream of water into the mixing section for mixing with the selected product.

2. The shower head of claim 1, further comprising:

a shower stream output section coupled to the mixing section for dispensing the stream of water mixed with the selected product through a plurality of openings provided in the shower stream output section.

3. The shower head of claim 1, further comprising:

a product introduction section coupled to the container section and including a plurality of openings corresponding to the plurality of containers, respectively, for filling the plurality of containers with the plurality of respective products to be dispensed.

4. The shower head of claim 1, wherein the opening in the selection section includes one or more triangle-shaped openings therein, one or more circular-shaped openings therein, or one or more square-shaped openings therein.

5. The shower head of claim 1, wherein the selection section includes a selection tab for rotating the selection section between the container section and the mixing section.

6. The shower head of claim 1, wherein the shower head is eggshaped, diamond-shaped, square-shaped, or circular-shaped.

7. A shower head, comprising:

a container means including a plurality of containers therein for storing a plurality of respective products to be dispensed;

a selection means rotatably mounted on the container means for selecting a product to be dispensed via an opening provided in the selection means;

a mixing means coupled to the selection means for receiving a selected product from the selection means and mixing the selected product with a water stream; and an internal water spout means passing through the container means and the selection means into the mixing means for introducing the stream of water into the mixing means for mixing with the selected product.

8. The shower head of claim 7, further comprising:

a shower stream output means coupled to the mixing means for dispensing the stream of water mixed with the selected product through a plurality of openings provided in the shower stream output means.

9. The shower head of claim 7, further comprising:

a product introduction means coupled to the container means and including a plurality of openings corresponding to the plurality of containers, respectively, for filling the plurality of containers with the plurality of respective products to be dispensed.

10. The shower head of claim 7, wherein the opening in the selection means includes one or more triangle-shaped openings therein, one or more circular-shaped openings therein, or one or more square-shaped openings therein.

11. The shower head of claim 7, wherein the selection means includes a selection tab for rotating the selection means between the container means and the mixing means.

12. The shower head of claim 7, wherein the shower head is egg-shaped, diamond-shaped, square-shaped, or circular-shaped.

13. A method of using a shower head including container, selection and mixing means, the method comprising:

storing a product to be dispensed in one of a plurality of containers of the container means; and selecting the product to be dispensed by rotating the selection means rotatably mounted on the container means and including an opening provided therein, wherein the mixing means coupled to the selection means receives the selected product from the selection means and mixes the selected product with a water stream, and an internal water spout means passing through the container means and the selection means into the mixing means introduces the stream of water into the mixing means for mixing with the selected product.

14. The method of claim 13, wherein a shower stream output means coupled to the mixing means dispenses the stream of water mixed with the selected product through a plurality of openings provided in the shower stream output means.

15. The method of claim 13, wherein a product introduction means coupled to the container means and including a plurality of openings corresponding to the plurality of containers, respectively, fills the plurality of containers with the plurality of respective to be dispensed.

16. The method of claim 13, wherein the opening in the selection means includes one or more triangle-shaped openings therein, one or more circular-shaped openings therein, or one or more square-shaped openings therein.

17. The method of claim 13, wherein the selection means includes a selection tab for rotating the selection means between the container means and the mixing means.

18. The method of claim 13, wherein the shower head is egg-shaped, diamond-shaped, square-shaped, or circular-shaped.

* * * * *